US010009675B2

(12) United States Patent
Xiao et al.

(10) Patent No.: US 10,009,675 B2
(45) Date of Patent: Jun. 26, 2018

(54) MINIATURE SOUNDER

(71) Applicants: Bo Xiao, Shenzhen (CN); Ronglin Linghu, Shenzhen (CN)

(72) Inventors: Bo Xiao, Shenzhen (CN); Ronglin Linghu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days. days.

(21) Appl. No.: 15/416,168

(22) Filed: Jan. 26, 2017

(65) Prior Publication Data

US 2017/0339478 A1 Nov. 23, 2017

(30) Foreign Application Priority Data

May 17, 2016 (CN) ..... 2016 2 0447342 U

(51) Int. Cl.
*H04R 1/06* (2006.01)
*H04R 9/06* (2006.01)
*H04R 9/02* (2006.01)

(52) U.S. Cl.
CPC ..... *H04R 1/06* (2013.01); *H04R 9/025* (2013.01); *H04R 9/06* (2013.01)

(58) Field of Classification Search
CPC ..... H04R 2499/11; H04R 9/06; H04R 1/06; H04R 7/14; H04R 9/025; H04R 9/045; H04R 9/046; H04R 9/063; H04R 9/10
USPC ..... 381/401–422
See application file for complete search history.

(56) References Cited

U.S. PATENT DOCUMENTS

2004/0196987 A1* 10/2004 Sahyoun ..... H04R 1/06 381/111
2008/0205689 A1* 8/2008 Lutz ..... H04R 9/06 381/409
2011/0299703 A1* 12/2011 Annamaa ..... H01Q 1/52 381/94.1
2012/0177247 A1* 7/2012 Li ..... H04R 9/025 381/412
2013/0322679 A1* 12/2013 Jiang ..... H04R 9/06 381/398

(Continued)

*Primary Examiner* — Matthew Eason
*Assistant Examiner* — Julie X Dang
(74) *Attorney, Agent, or Firm* — IPro, LLC; Na Xu

(57) ABSTRACT

The present invention provides a miniature loudspeaker, including a voice coil. The voice coil includes a voice coil body and four voice coil leads connected to the voice coil body. The voice coil body includes four corners, each of which is provided with a voice coil lead. The four voice coil leads are fixed to the frame and support the voice coil body. Each voice coil lead includes a first connecting portion connected to the voice coil body, a second connecting portion fixed to the frame, and a third connecting portion connecting the first connecting portion and the second connecting portion. The third connecting portion is wound into a helical structure. The voice coil of the miniature loudspeaker provided in the present invention is divided into four voice coil leads, which are respectively disposed at positions of four corners of the voice coil body and are wound into a helical structure to support the voice coil body, such that the voice coil bears even force and vibrates stably in the vibration process, thereby resolving the vibration system swing problem and improving sound quality of the miniature loudspeaker.

4 Claims, 2 Drawing Sheets

(56) References Cited

U.S. PATENT DOCUMENTS

2015/0189442 A1* 7/2015 Zhang ..... H04R 9/025
381/409

* cited by examiner

MINIATURE SOUNDER

TECHNICAL FIELD

The present invention relates to the field of electro-acoustic conversion, and in particular, to a miniature loudspeaker.

BACKGROUND

In recent years, with the rapid development of mobile communication technologies, consumers are increasingly using voice-enabled mobile communication devices, such as, portable telephones, handheld game consoles, and laptops. For a miniature loudspeaker as a voice playback device, its design directly affects the voice performance of a mobile communication device product in the related art.

A miniature loudspeaker in the related art includes a frame, and a magnetic path system and a vibration system housed in the frame. The vibration system includes a vibrating diaphragm and a voice coil which drives the vibrating diaphragm to vibrate and generate a sound. As a result of pulling force on the voice coil applied by the two voice coil leads, uneven force is applied to the voice coil in the vibration process, vibration is instable, and voice coil swing is aggravated, thereby affecting vibration of the vibration system, and affecting voice quality of the product.

Therefore, it is desired to provide a novel miniature loudspeaker to solve the above-mentioned technical problem.

SUMMARY

Some embodiments of the present invention aims to provide a miniature loudspeaker of which a voice coil bears even force and vibrates stably in the vibration process, thereby solving the vibration system swing problem and improving sound quality.

The objective of an embodiment of the present invention is realized as follows:

A miniature loudspeaker includes a frame having an accommodation space, and a magnetic path system and a vibration system housed in the accommodation space, the vibration system including a vibrating diaphragm and a voice coil which drives the vibrating diaphragm to vibrate and generate a sound, where the voice coil includes a voice coil body and four voice coil leads connected to the voice coil body, the voice coil body includes four corners, each of which is provided with a voice coil lead, the four voice coil leads are fixed to the frame and support the voice coil body, and each voice coil lead includes a first connecting portion connected to the voice coil body, a second connecting portion fixed to the frame, and a third connecting portion connecting the first connecting portion and the second connecting portion, the third connecting portion being wound into a helical structure.

In one example, the frame is provided with a pad, and the second connecting portion is fixed by soldering with the pad.

In one example, the helical structure is wound and extends in a vibration direction of the vibration system.

In one example, the voice coil body includes an upper end face close to the vibrating diaphragm and a lower end face disposed opposite to the upper end face, and the first connecting portion is connected to the lower end face.

In one example, the two voice coil leads are integrated with the voice coil body and are connected to an external circuit to implement power supply to the voice coil, and the another two voice coil leads are connected and fixed to the voice coil body by means of gluing or soldering.

Some embodiments of the present invention have the beneficial effects that: the voice coil of the miniature loudspeaker provided in the present invention is divided into four voice coil leads, which are respectively disposed at positions of four corners of the voice coil body and are wound into a helical structure to support the voice coil body, such that the voice coil bears even force and vibrates stably in the vibration process, thereby resolving the vibration system swing problem and improving sound quality of the miniature loudspeaker.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS

The accompanying drawings, which are incorporated herein and form part of the specification, illustrate the present invention and, together with the description, further serve to explain the principles of the invention and to enable a person skilled in the relevant art(s) to make and use the invention. Embodiments of the invention are described, by way of example only, with reference to the accompanying drawings, in which.

Figure 1:
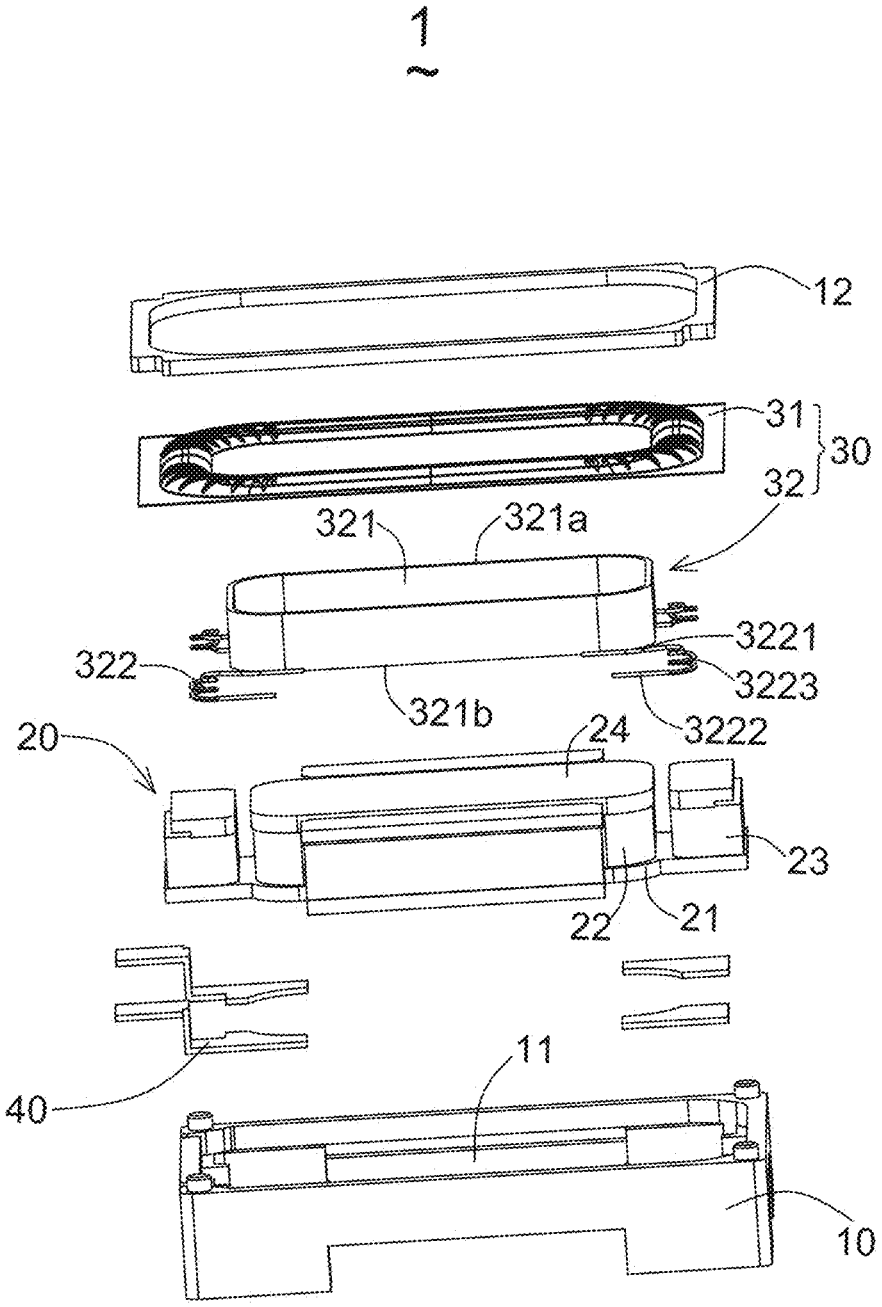
FIG. 1 is an isometric exploded view of a part of a miniature loudspeaker according to some embodiments in the invention.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION

This specification discloses one or more embodiments that incorporate the features of this invention. The disclosed embodiment(s) merely exemplify the invention. The scope of the invention is not limited to the disclosed embodiment (s). The invention is defined by the claims appended hereto. The embodiment(s) described, and references in the specification to "one embodiment", "an embodiment", "an example embodiment", etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the art to effect such feature, structure, or characteristic in connection with other embodiments whether or not explicitly described.

The partial embodiment(s) of the present invention is described in detail below with reference to the accompanying drawings.

Figure 2:
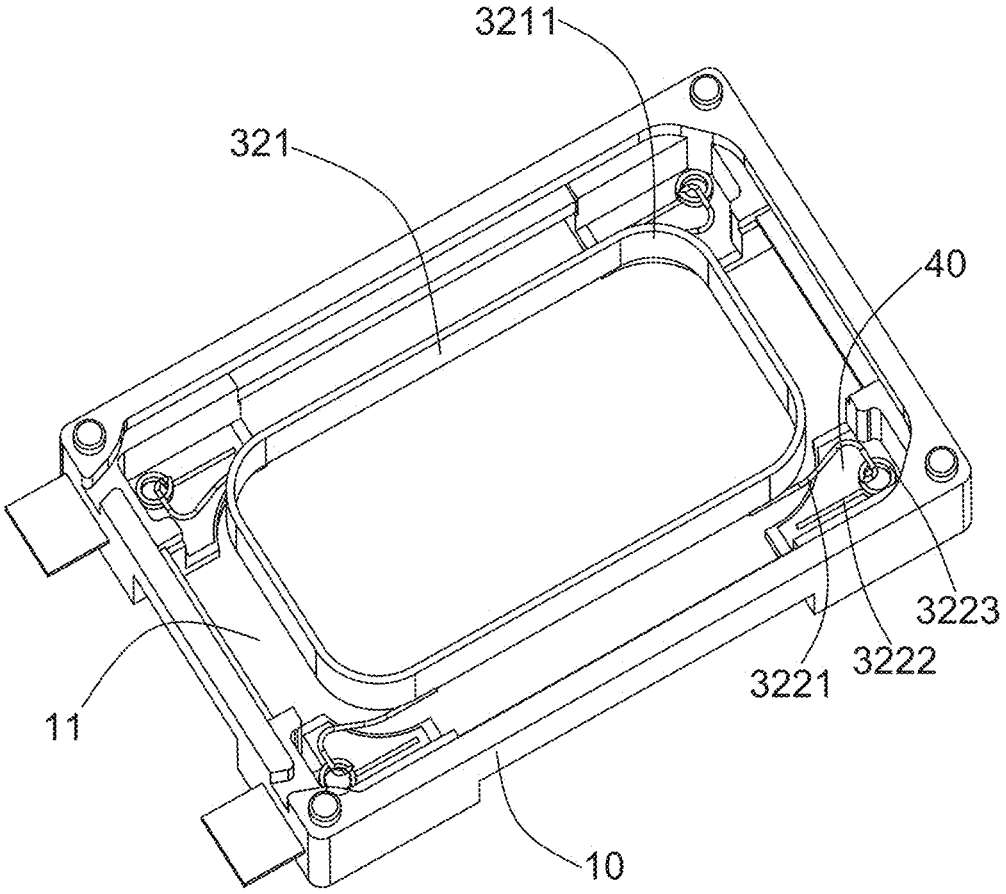
FIG. 2 is a schematic diagram of a combination of a voice coil, a frame, and a pad of a miniature loudspeaker according to some embodiments in the present invention.

As shown in FIG. 1 and FIG. 2, a miniature loudspeaker 1 provided in some embodiments of the present invention includes a frame 10 having an accommodation space 11, a magnetic path system 20 and a vibration system 30 housed in the accommodation space 11, and a front cover 12 connected to the frame 10 in a covering manner.

The magnetic path system 20 includes a lower clamping plate 21, a primary magnet 22, four secondary magnets 23 attached to the lower clamping plate 21, and a pole core 24 attached to the primary magnet 22 and the secondary magnets 23.

The vibration system 30 includes a vibrating diaphragm 31 and a voice coil 32 which drives the vibrating diaphragm 31 to vibrate and generate a sound. The voice coil 32 includes a voice coil body 321 and four voice coil leads 322 connected to the voice coil body 321.

The voice coil body 321 includes four corners 3211, each of which is provided with a voice coil lead 322. The four voice coil leads 322 are fixed to the frame 10 and support the voice coil body 321. Each voice coil lead 322 includes a first connecting portion 3221 connected to the voice coil body 321, a second connecting portion 3222 fixed to the frame 10, and a third connecting portion 3223 connecting the first connecting portion 3221 and the second connecting portion 3222. The third connecting portion 3223 is wound into a helical structure. In this implementation manner, the helical structure is wound and extends in a vibration direction of the vibration system 30.

The voice coil body 321 includes an upper end face 321*a* close to the vibrating diaphragm 31 and a lower end face 321*b* disposed opposite to the upper end face 321*a*. In this implementation manner, the first connecting portion 3221 is connected to the lower end face 321*b*.

The frame 10 is provided with a pad 40. The manner in which the voice coil lead 322 is fixed to the frame 10 may be soldering and fixing the second connecting portion 3222 and the pad 40.

In this implementation manner, the two voice coil leads 322 is integrally wound around the voice coil body 321 and is connected to an external circuit to implement power supply to the voice coil. In addition, the two voice coil leads 322 are connected and fixed to the voice coil body 321 by means of gluing or soldering. The voice coil lead 322 not only plays a role of supporting, but also can conduct electricity. Certainly, in other implementation manners, a voice coil body 321 wound with a conductive wire and a positive wire outlet and a negative wire outlet wired out from the upper end face 321*a* of the voice coil body 321 may also be selected for conduction. The four voice coil leads 322 are connected to the lower end face 321*b* of the voice coil body 321 by means of gluing or soldering, and are used for supporting only.

The voice coil of the miniature loudspeaker provided in the present invention is divided into four voice coil leads, which are respectively disposed at positions of four corners of the voice coil body and are wound into a helical structure to support the voice coil body, such that the voice coil bears even force and vibrates stably in the vibration process. Therefore, the vibration system swing problem is solved, sound quality of the miniature loudspeaker is improved, and thus a maximum low frequency output sound pressure of the miniature loudspeaker can be effectively improved. In addition, the wire disconnection risk of the voice coil leads is also reduced, and reliability of the miniature loudspeaker is improved.

The above descriptions are only implementation manners of the present invention, and it should be noted that a person skilled in the art may further make improvements therefore without departing from the inventive concept of the present invention. However, these improvements fall within the protection scope of the present invention.

What is claimed is:

1. A miniature loudspeaker, comprising: a frame having an accommodation space, and a magnetic path system and a vibration system housed in the accommodation space, the vibration system comprising a vibrating diaphragm and a voice coil which drives the vibrating diaphragm to vibrate and generate a sound; wherein the voice coil comprises a voice coil body and four voice coil leads connected to the voice coil body; wherein the voice coil body comprises four comers and each of which is provided with a voice coil lead; wherein the four voice coil leads are fixed to the frame and support the voice coil body, and each voice coil lead comprises a first connecting portion connected to the voice coil body, a second connecting portion fixed to the frame, and a third connecting portion connecting the first connecting portion and the second connecting portion, the third connecting portion being wound into a helical structure, the third connecting portion is suspended between the first connecting portion and the second connecting portion in a vibration direction of the vibration system; and the first connecting portion extends in a direction from the corner adjacent thereto toward the third connecting portion; wherein the voice coil body comprises an upper end face close to the vibrating diaphragm and a lower end face disposed opposite to the upper end face, the first connecting portion is connected to the lower end face, the voice coil body is suspended between the vibrating diaphragm and the voice coil leads, and the lower end is supported by all of the voice coil leads; wherein the four voice coil leads are symmetrically formed around the voice coil body.

2. The miniature loudspeaker according to claim 1, wherein the frame is provided with a pad, and the second connecting portion is fixed by soldering with the pad, and the voice coil lead is positioned between the voice coil body and the pad in the vibration direction of the vibration system.

3. The miniature loudspeaker according to claim 1, wherein the helical structure is wound and extends in the vibration direction of the vibration system.

4. The miniature loudspeaker according to claim 1, wherein the two voice coil leads are integrated with the voice coil body and are connected to an external circuit to implement power supply to the voice coil, and the two voice coil leads are connected and fixed to the voice coil body by means of gluing or soldering.

* * * * *